US007841801B2

(12) United States Patent
Burnes

(10) Patent No.: US 7,841,801 B2
(45) Date of Patent: Nov. 30, 2010

(54) SPLASH PLATE

(76) Inventor: James J. Burnes, 10 Tower Hill Lake Rd., Deep River, CT (US) 06417

( * ) Notice: Subject to any disclaimer, the term of this patent is extended or adjusted under 35 U.S.C. 154(b) by 147 days.

(21) Appl. No.: 11/801,907

(22) Filed: May 10, 2007

(65) Prior Publication Data

US 2007/0264082 A1 Nov. 15, 2007

Related U.S. Application Data

(60) Provisional application No. 60/799,593, filed on May 10, 2006.

(51) Int. Cl.
*E02B 13/00* (2006.01)

(52) U.S. Cl. ..... 405/46; 405/36; 405/43

(58) Field of Classification Search ..... 405/36, 405/49, 100, 158.1, 335, 43–46
See application file for complete search history.

(56) References Cited

U.S. PATENT DOCUMENTS 980,442 A * 1/1911 Schlaply ..... 405/48
4,360,042 A * 11/1982 Fouss et al. ..... 138/119
5,498,104 A * 3/1996 Gray ..... 405/43
6,129,482 A * 10/2000 Ditullio ..... 405/43
6,361,248 B1 * 3/2002 Maestro ..... 405/49
2005/0100410 A1 * 5/2005 Maestro ..... 405/46
2005/0121381 A1 * 6/2005 Sheets et al. ..... 210/331

* cited by examiner

*Primary Examiner*—David J Bagnell
*Assistant Examiner*—Benjamin Fiorello
(74) *Attorney, Agent, or Firm*—Steven M McHugh

(57) ABSTRACT

A splash plate for use with an end cap or end portion of a chamber is provided, wherein the end cap or end portion defines an end cavity having an open end cavity bottom and includes an opening for containing a waste water pipe that introduces waste water into the end cavity. The splash plate includes a base panel for covering the end cavity bottom such that waste water introduced into the end cavity contacts at least a portion of said base panel and a means for positionably securing the splash plate relative to the end cap or end portion.

20 Claims, 7 Drawing Sheets

SPLASH PLATE

RELATED APPLICATIONS

This application claims the benefit of U.S. Provisional Application Ser. No. 60/799,593 filed May 10, 2006 entitled "Full Coverage Perforated Splash Plate for Leaching Chamber", the contents of which are incorporated herein by reference in its entirety.

FIELD OF THE INVENTION

This invention relates generally to leaching chambers and more particularly to a splash plate for an end cap for use with a leaching chamber.

BACKGROUND OF THE INVENTION

Plastic leaching chambers having an arch shape cross section are known in the art and are commonly buried within trenches that are dug into the soil. Waste water coming from a source, such as a septic tank, is typically conveyed to the first leaching chamber of a string of leaching chambers by means of an inflow pipe, wherein the waste water enters the first leaching chamber via the inflow pipe which is inserted into an opening, or hole, in the end plate or end cap of the chamber. Because the inflow pipe is often inserted into the hole in the end plate at an elevation above the soil, wherein the soil typically lies at the base level of the chamber, the water projects a short distance into the chamber. Unfortunately, as the water flows through the pipe and into the chamber, the force of the water dropping from the pipe onto the soil at the bottom of the chamber can cause erosion of the soil, thus possibly undermining the chamber over time or even causing drain holes to become clogged. One method that has been used to avoid this problem involves placing a flat stone or fabricated plate of plastic or concrete, generally called a splash plate, upon the soil so that the plate lies within the chamber vertically below the place where the inflow pipe discharges.

Some plastic end caps that are sold in commerce are sold by Infiltrator Systems Inc. of Old Saybrook, Conn. and often include such kind of splash plate, wherein a typical splash plate may be about 6 inches by 8 inches in dimension. The edge of the splash plate may have tabs that mechanically engage the base of the end cap to keep the splash plate from moving over time, such as by floating or by force of the water hitting the splash plate. For example, FIG. 1 illustrates one such splash plate 102, in accordance with the prior art, associated with an end cap 100 as disclosed in U.S. Pat. No. 7,008,138 to Burnes et al., and is referred to further hereinafter.

When the waste water flows into the chamber by gravity at a relatively low volumetric flow rate, the water tends to drop vertically downward at the entry point. In this case, the installer may be fairly confident that he knows where to position the splash plate to avoid soil erosion. However, prior art splash plates are not well suited to address the problems that exist when the waste water is sent to the chamber by means of a dosing pump. This is because the volumetric flow rate of the water from the dosing pump may vary from time to time and is typically higher than water flowing solely by gravity. This higher flow rate causes the water to project farther into the chamber and unfortunately, the location of the landing point of the water typically varies from installation to installation and from time to time during use.

In such situations, it has been found that soil erosion still occurs with the prior art splash plates because the water projected into the chamber either flows rapidly off of the splash plate and into the chamber, only partially lands on the splash plates or overshoots the splash plates altogether. This is undesirable for several reasons. First, because during erosion the soil is washed away and typically flows downstream into the chamber, the eroded soil can clog the drain holes preventing needed flow. Second, in one worse case scenario, as more and more soil at the base level of the chamber erodes, the stability of the chamber can become compromised and if enough soil erodes away, the chambers can shift. Third, in another worse case scenario, if enough soil is eroded such that the soil supporting the end cap could be undermined over time, the end cap could be allowed to shift away from the chamber.

SUMMARY OF THE INVENTION

In an embodiment, a splash plate for use with an end cap or end portion of a chamber, wherein the end cap or end portion defines an end cavity having an open end cavity bottom and includes an opening for containing a waste water pipe that introduces waste water into the end cavity is provided. The splash plate includes a base panel, wherein the base panel is configured to cover the end cavity bottom when the splash plate is associated with the chamber, such that waste water being introduced into the end cavity contacts the base panel. The splash plate also includes a plurality of upright side portions, wherein each of the plurality of upright side portions is configured to interact with the end cap or end portion when the splash plate is associated with the chamber to inhibit longitudinal motion of the splash plate within the end cavity. Furthermore, the splash plate includes a baffle portion, wherein the baffle portion is configured to interact with the end cap or end portion when the splash plate is associated with the chamber to inhibit lateral movement of the splash plate and longitudinal movement of the baffle portion within the end cavity.

In another embodiment, an assembly is provided, wherein the assembly includes an end cap or a end portion of a chamber having an interior end cavity with an open end cavity bottom and a base flange. The assembly also includes a splash plate, wherein the splash plate includes a base panel disposed and configured to closely associate with the base flange to cover a substantial portion of the end cavity bottom, such that waste water being introduced into the end cavity contacts the base panel. The splash plate also includes a plurality of upright side portions, wherein each of the plurality of upright side portions is configured to interact with the end cap or end portion to inhibit longitudinal motion of the splash plate within the end cavity. Furthermore, the splash plate includes a baffle portion, wherein the baffle portion is configured to interact with the end cap or end portion to inhibit lateral movement of the splash plate and longitudinal movement of the baffle portion within the end cavity.

In another embodiment, a splash plate for use with an end cap or end portion of a chamber is provided, wherein the end cap or end portion defines an end cavity having an open end cavity bottom and includes an opening for containing a waste water pipe that introduces waste water into the end cavity. The splash plate includes a base panel for covering the end cavity bottom such that waste water introduced into the end cavity contacts at least a portion of said base panel and a means for positionably securing the splash plate relative to the end cap or end portion.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION

Figure 1:
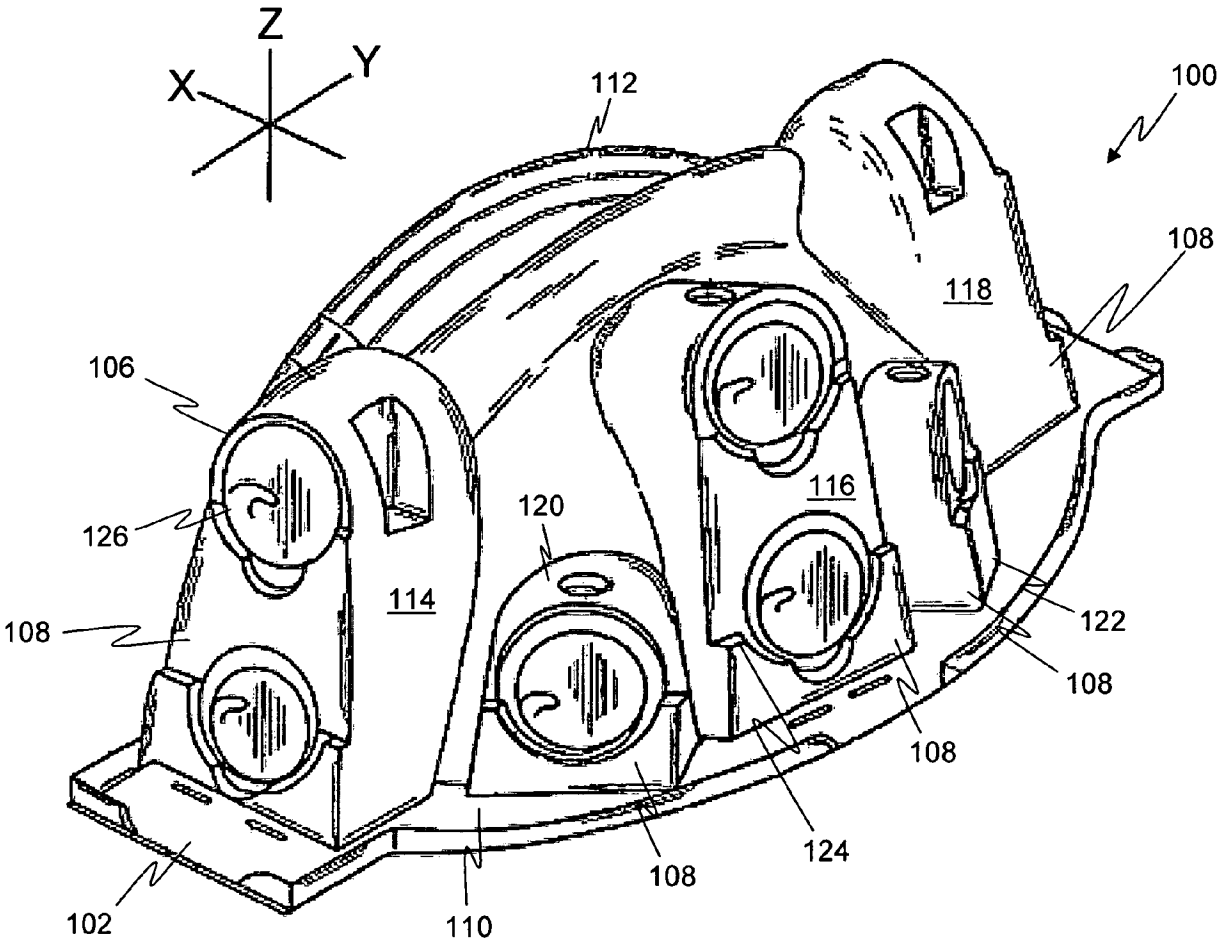
Figure 1 PRIOR ART
FIG. 1 is an isometric view of a splash plate associated with an end cap in accordance with the prior art.

It should be appreciated that the present invention is described herein in terms for use in combination with a molded thermoplastic end cap 100, such as that shown in FIG. 1 and as disclosed in U.S. Pat. No. 7,008,138 to Burnes et al., issued Mar. 7, 2006 and entitled "Faceted End Cap for Leaching Chamber," the contents of which are hereby incorporated by reference in its entirety. The end cap 100 includes a dome shaped shell having an interior cavity and at least pull seal tab which can be removed to create at least one opening 106 in the buttress portion 108 of the end cap 100 for receiving at least one waste water pipe. This allows waste water to be introduced or dumped into the interior cavity of the end cap 100 via the waste water pipe. The end cap 100 includes a base flange 110 and a curved arch shaped end flange 112 for engaging a leaching chamber. The buttress portion 108 includes three large spaced apart buttresses 114, 116, 118 and two small buttresses 120, 122, wherein the small buttresses 120, 122 are located intermediate the large buttresses 114, 116, 118 such that small buttress 120 is located between large buttress 114 and large buttress 116 and small buttress 122 is located between large buttress 116 and large buttress 118. It should be appreciated that each buttress has at least one saddle portion 124 for supporting a pipe which may be inserted into the opening 106 which is typically created by removal of a pull-tab seal 126.

Figure 2:
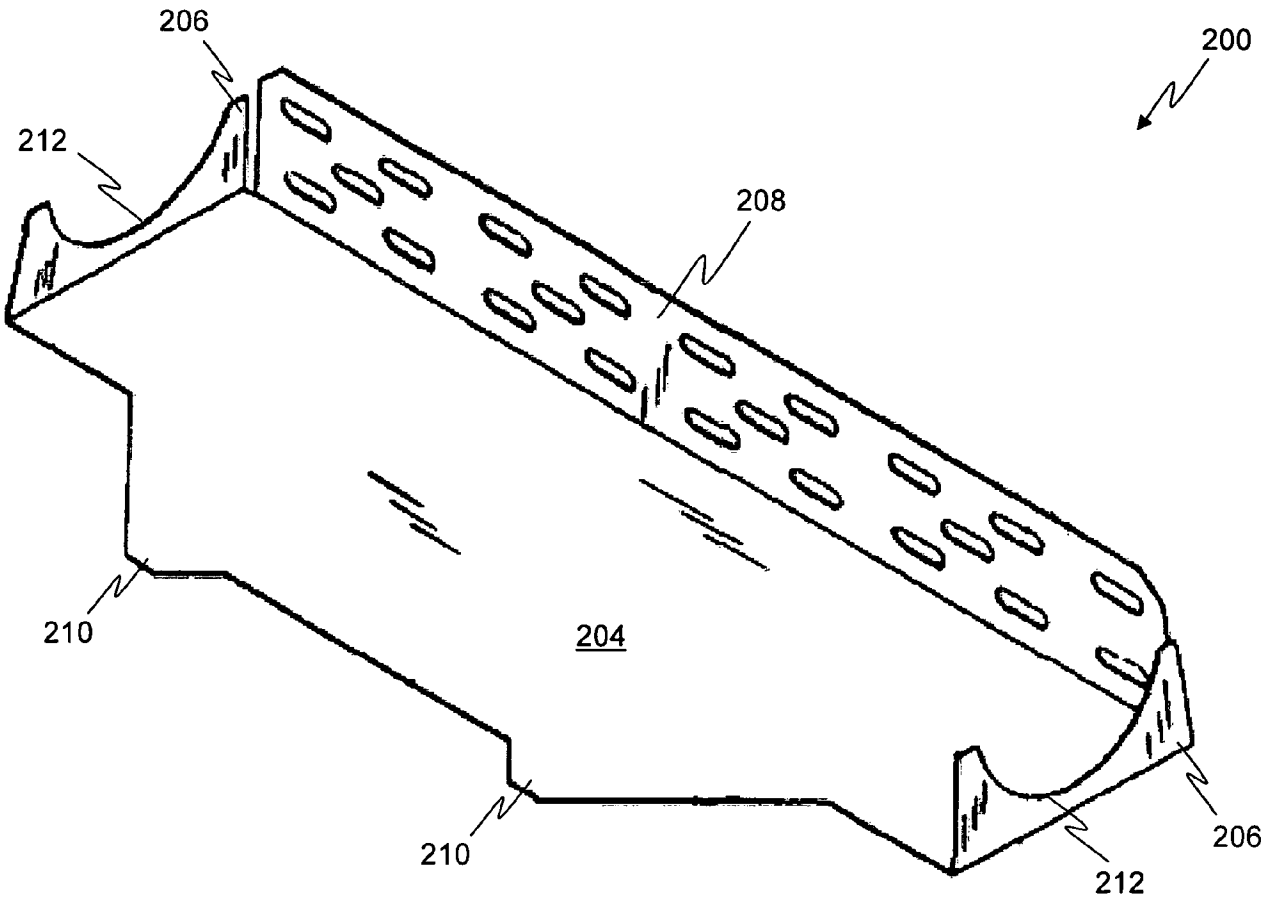
FIG. 2 is a top down isometric view illustrating a first embodiment of a splash plate, in accordance with the present invention.
Figure 3:
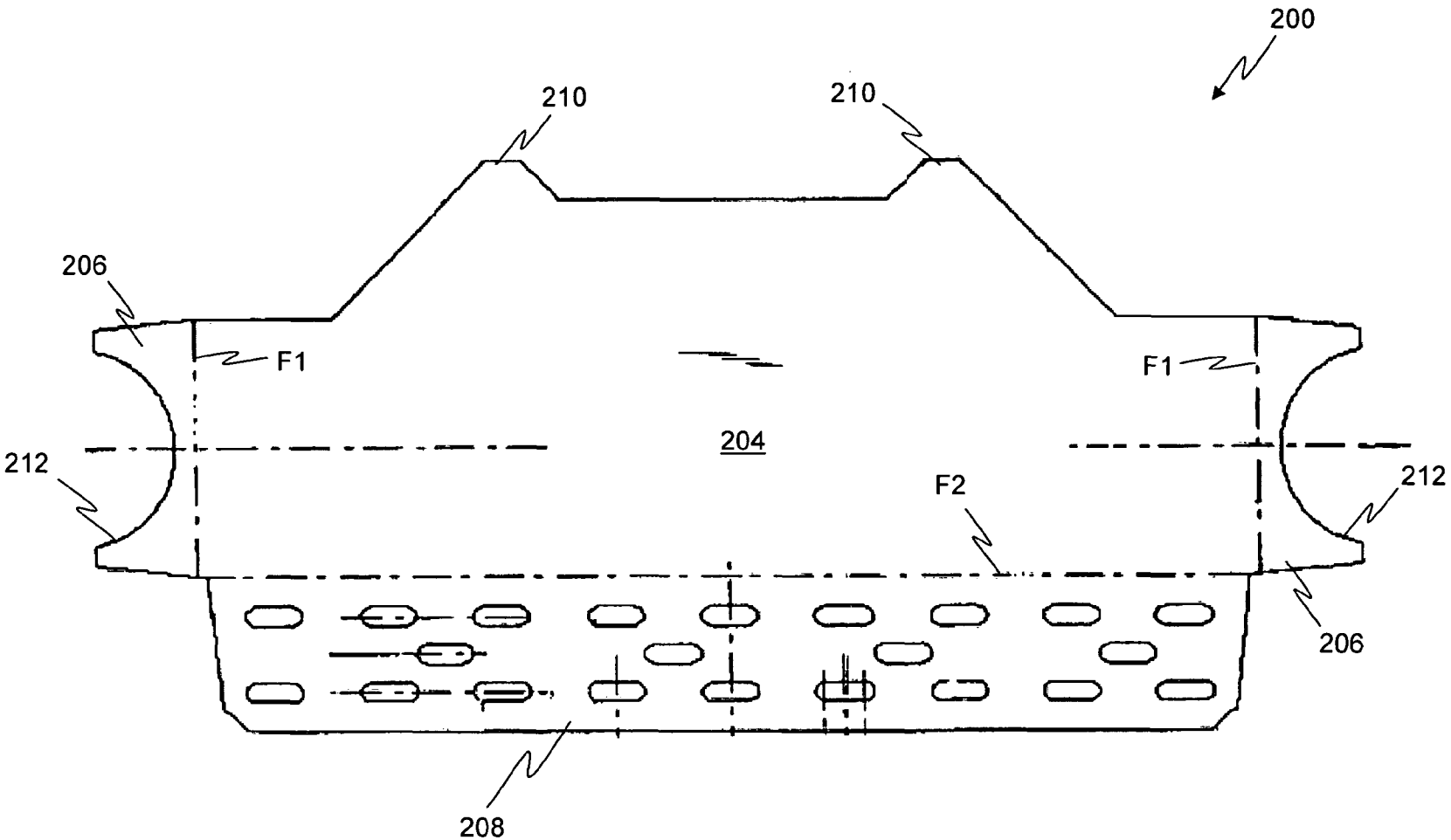
FIG. 3 is a planar view of the splash plate of FIG. 2 in flattened condition, suitable for shipment prior to use and in accordance with the present invention.
Figure 4:
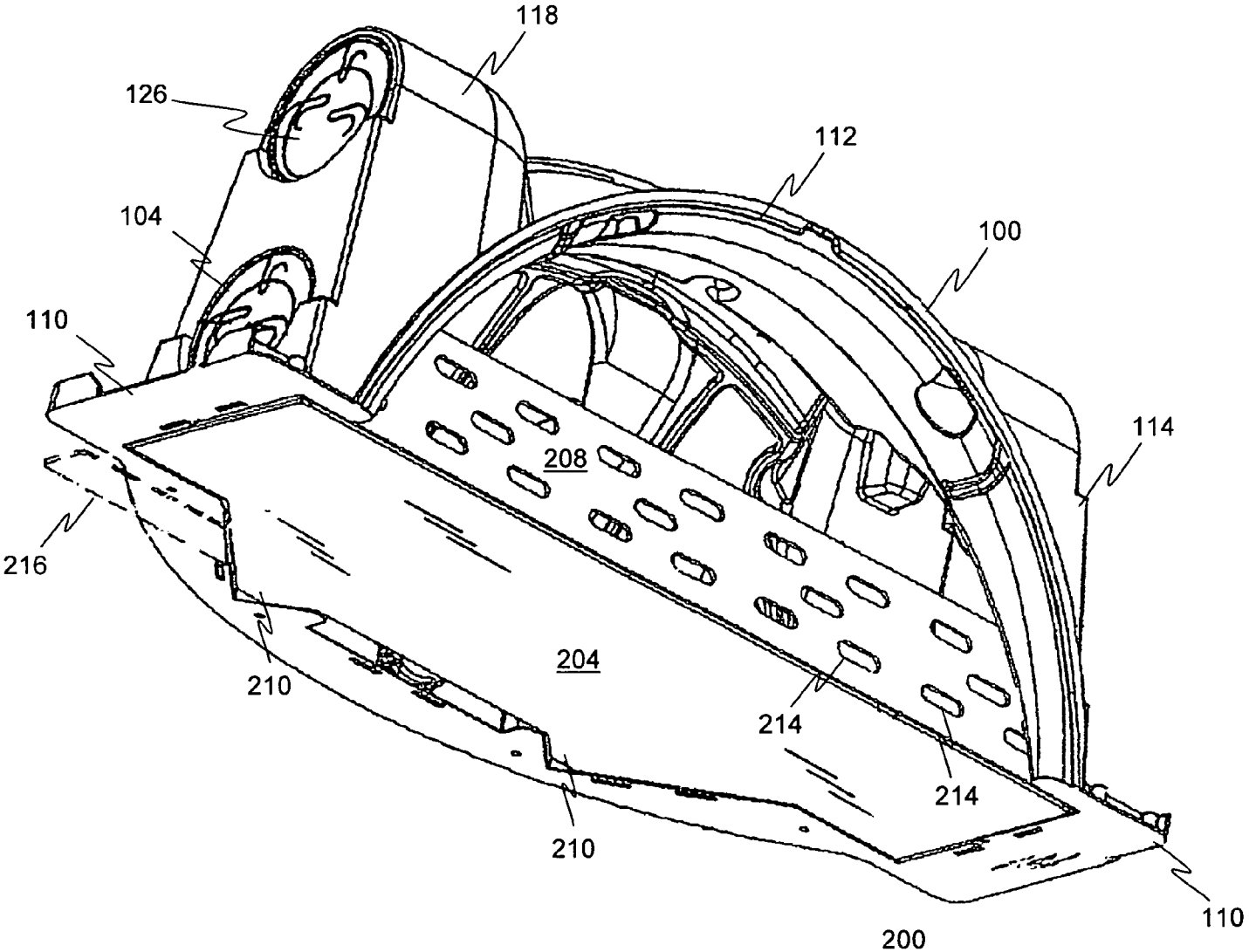
FIG. 4 is an isometric view bottom up view of the splash plate of FIG. 2 associated with an end cap, in accordance with the present invention.

Referring to FIG. 2 and FIG. 3, a first embodiment of a slash plate 200, in accordance with the present invention, is shown and includes a base panel 204, opposing side upright portions 206 and a baffle portion 208, wherein the base panel 204 includes one or more tab portions 210 and wherein the side upright portions 206 include semi-circular cutouts 212. Referring to FIG. 4, the slash plate 200 is shown associated with an end cap 100 to be closely mated with the base of the end cap 100, wherein the base panel 204 is disposed to be parallel with and at approximately the same elevation as the base flange 110. As shown, the tab portions 210 of flash plate 200 are configured to fit and substantially spans (i.e. to at least partially cover the soil that underlies the end cap 100) the interior space within the base flange portion 110 of the end cap 100.

Additionally, the side upright portions 206 are disposed inside of the end cap cavity to be located adjacent the lower openings 106 in large buttress 114 and large buttress 118. The side upright portions 206 may be configured to engage interior features of the end cap 100 and resist any longitudinal motion of the splash plate 200 in or out of the end cap 100 along the x-axis (as shown in FIG. 1), i.e. longitudinally with leaching chamber, wherein the semi-circular cutouts 212 provide clearance for any pipe that may be inserted into the opening 106 of the end cap 100. The side upright portions 206 may also engage the outer edges of the baffle portion 208 to help prevent the baffle portion 208 from falling inwardly into the interior of the end cap 100 and onto the top of the base panel 204.

Additionally, the baffle portion 208, which may include a plurality of integrated perforations 214, extends perpendicularly upright along the edge of the base panel 204 such that the baffle portion 208 nominally runs vertically and parallel to the plane of the end flange 112 of the end cap 100, wherein the baffle portion 208 is inset from the plane of the end of end cap 100. The opposing ends of the baffle portion 208 may be configured to engage recesses within the interior portion of the end flange 112 of the end cap 100. This allows the baffle portion 208 to remain upright against the force of water flowing from the cavity of the end cap 100 toward the attached leaching chamber. Moreover, the engagement of the baffle portion 208 with the opposing sides of the end cap 100 helps to restrain the baffle portion 208 and the whole splash plate 200 from moving sideways along the y-axis (as shown in FIG. 1), i.e. in a left-right fashion within the end cap 100.

It should be appreciated that the tab portion 210 may extend outwardly more than shown to at least partially underlie the curved outer edge of the base flange portion 110 to keep the edge of splash plate 200 from lifting. Optionally, an indicator tab 216, shown in phantom in FIG. 4, may be provided as an integral extension of the base panel 204 and may be configured to extend beyond the outer edge of the end cap base flange portion 110 to be visible from outside of the chamber. Not only would the indicator tab 216 substantially act as suggested for the tab portion 210, but it would also function as a visual indicator to an inspector that the splash plate 200 has been installed. Alternatively, all or part of the base panel 204 may extend beyond the end of the flange 110 to provide the desired indicator for the plate presence, in substation of the indicator tab 216. Moreover, while the upstream end of the splash plate 200 is curved to fit the interior bottom of the end cap 100 or chamber, it may be shaped in various other configurations. For instance, the end may be bigger than the interior so that it underlies all or a part of the flange 110.

Figure 5:
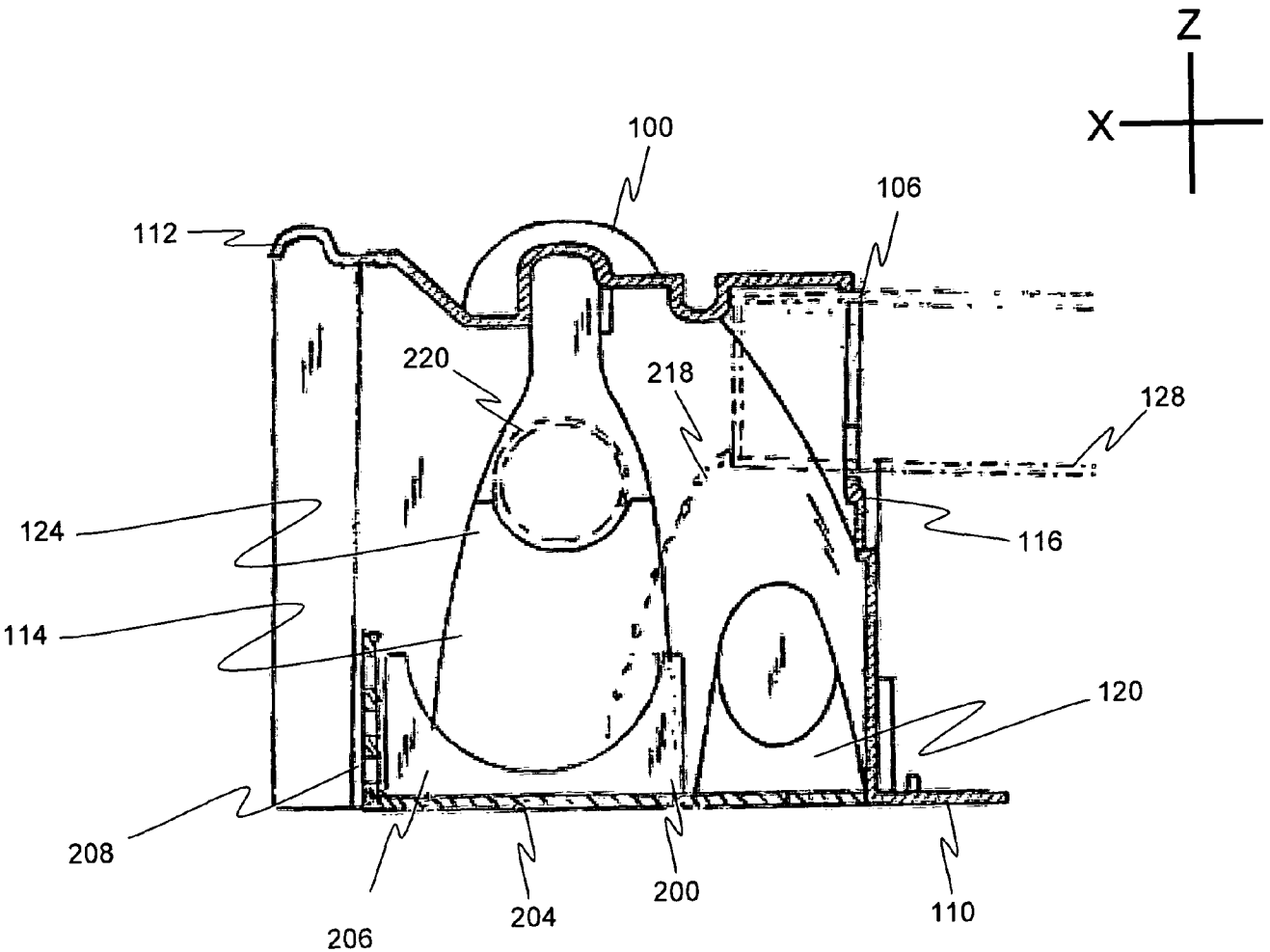
FIG. 5 is a cross-sectional side elevation view of an end cap and splash plate assembly, in accordance with the present invention, showing an inflow pipe in phantom.

Referring to FIG. 5, a splash plate 200 associated with an end cap 100 is shown having a waste water pipe 128 (shown in phantom) disposed within the opening 106 of large buttress 116 to introduce or dump waste water into the cavity of the end cap 100, wherein the waste water pipe 128 is resting on the saddle portion 124. FIG. 5 also shows a phantom stream 218 of waste water flowing from the waste water pipe 128 onto the base panel 204 of the splash plate 200. It should be appreciated that water falling from the waste water pipe 128 onto the splash plate 200 then flows in the lengthwise direction, i.e. along the x-axis (as shown in FIG. 5), along the surface of the base panel 204 and through the plurality of integrated perforations 214 of the baffle portion 208 depending on the volume.

In an alternate embodiment, the baffle portion 208 may be solid (i.e. lack integrated perforations 214) and as such, water deposited onto the base panel 204 may flow around the edges of the baffle portion 208, or it may accumulate and flow over the top edge of the baffle portion 208. In both instances, the baffle portion 208 may inhibit the lengthwise flow of water. Thus, it should be appreciated that any accumulation of water on the base panel 204 further serves to mitigate erosion of the soil, by providing a water cushion that absorbs the energy of the dropping water. Furthermore, in FIG. 5, to illustrate how the splash plate 200 is effective no matter what buttress is used to introduce waste water into the end cap 100, an additional waste water pipe 220 is also shown in phantom as being disposed in the upper opening 106 of and as resting on the saddle portion 124 of large buttress 114.

Figure 6:
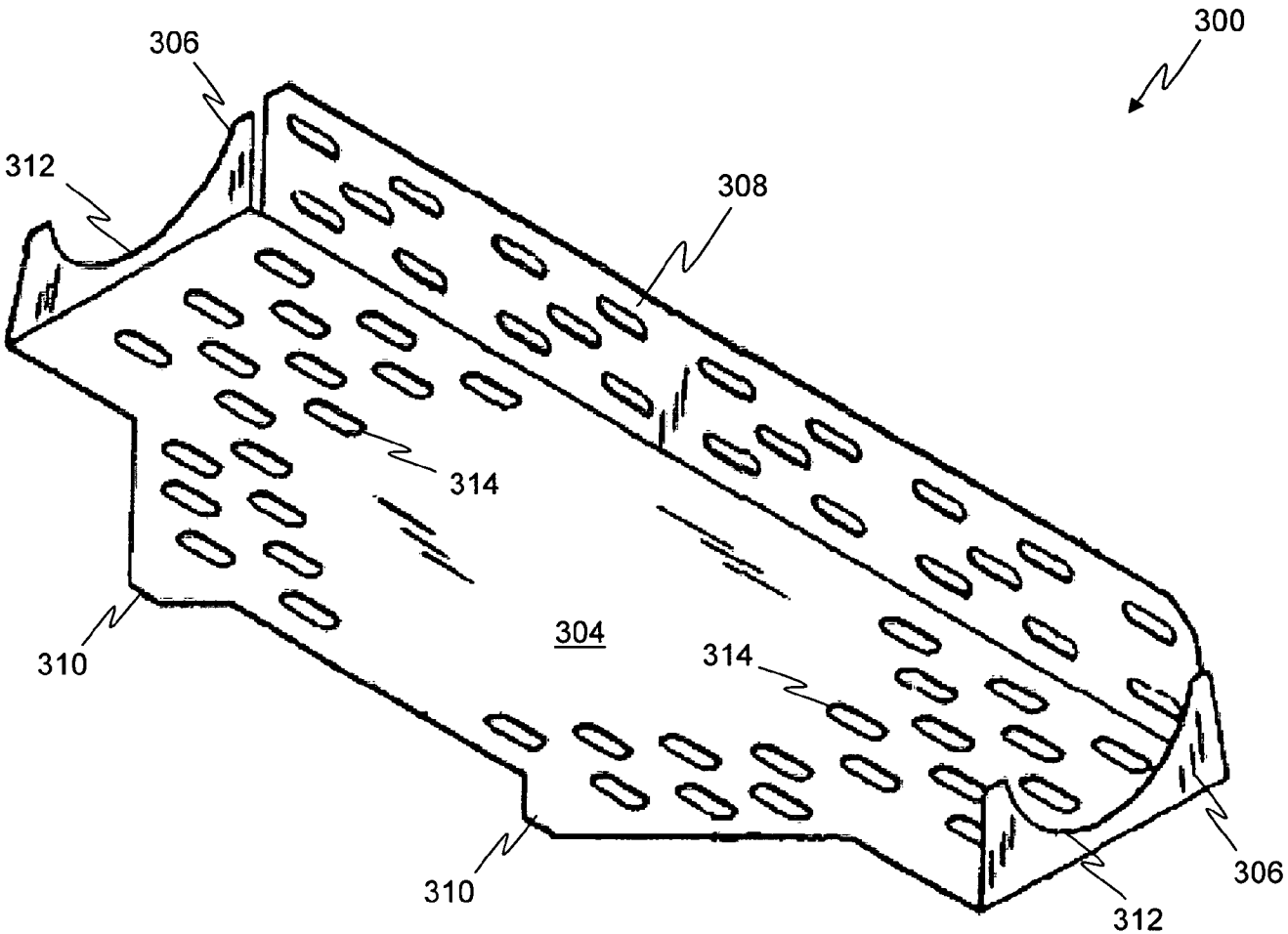
FIG. 6 is a top down isometric view illustrating a second embodiment of a splash plate, in accordance with the present invention.
Figure 7:
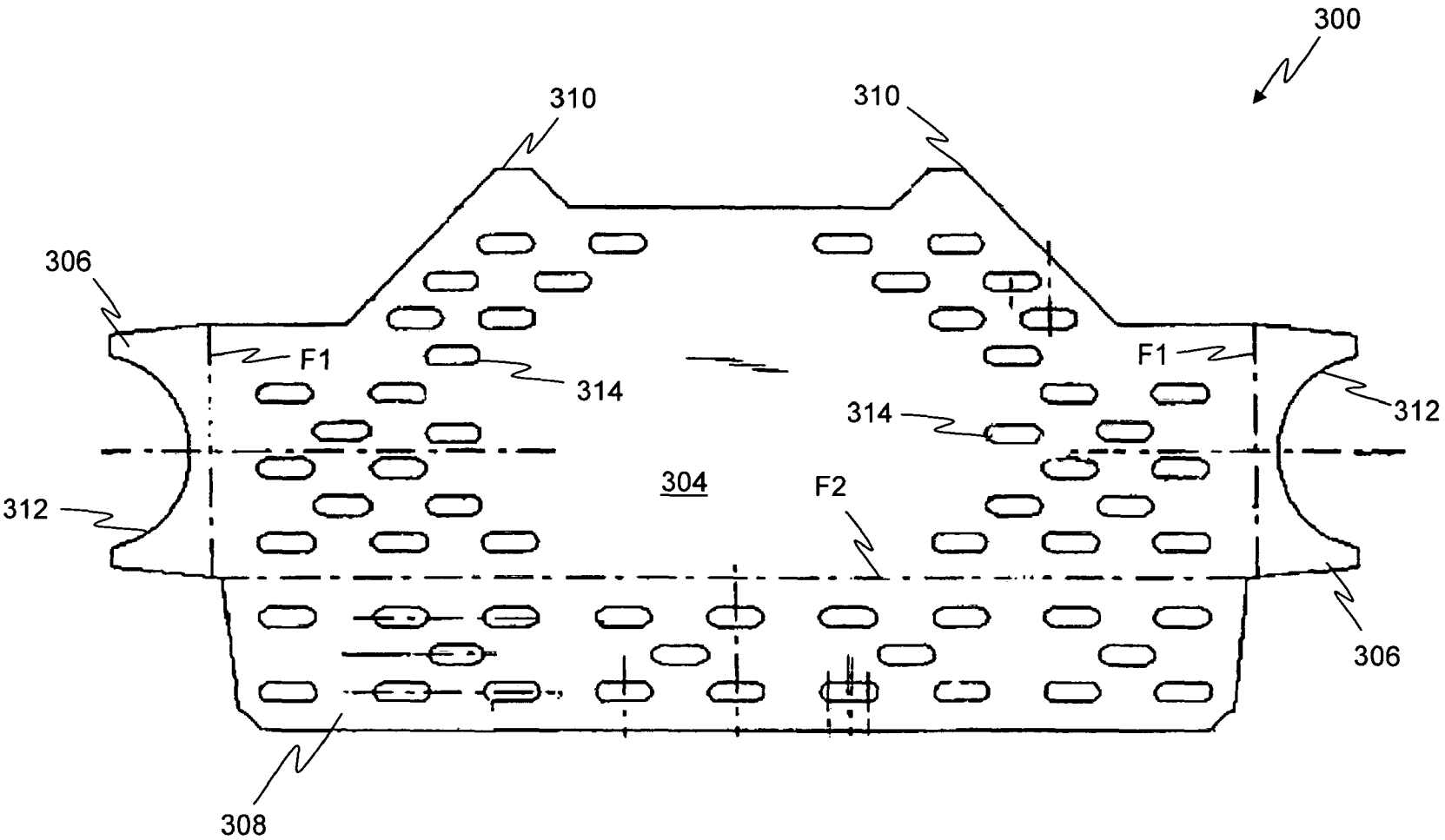
FIG. 7 is a planar view of the splash plate of FIG. 6 in flattened condition, suitable for shipment prior to use and in accordance with the present invention.

Referring to FIG. 6 and FIG. 7, a second embodiment of a slash plate 300, in accordance with the present invention, is shown and is similar to the splash plate 200 of FIG. 1. The splash plate 300 includes a base panel 304, opposing side upright portions 306 and a baffle portion 308, wherein the base panel 304 includes one or more tab portions 310 and wherein the side upright portions 306 include semi-circular cutouts 312. The splash plate 200 of the first embodiment differs from the splash plate of 300 of the second embodiment in that splash plate 300 includes a plurality of integrated perforations or holes 314 located in the base panel 304. This is because in certain situations the holes 314 help to better ensure that water flowing into the end cap 100 and onto the splash plate 300 can escape through the soil which underlies the interior of the end cap 100.

In accordance with the present invention, the baffle portion 208, 308 should sufficient height to impede the flow of water which may cause erosion, but not so high that it creates a dam having a resultant water fall affect which itself may cause erosion of the soil downstream and/or under the splash plate. For example, one such embodiment might include a baffle 208, 308 that is between about 0.5 inches high and about 5 inches high. Furthermore, while the baffle portion 208, 308 is shown herein as being a vertical portion, the baffle portion 208, 308 may be sloped or may be non-planar. For example, the end of base panel 204, 304 and the baffle portion 208, 308 may run along a zig-zag path from one side of the chamber to the other and/or the baffle portion 208, 308 may be corrugated.

The holes 214, 314 may have various sizes, shapes and patterns that differ from the holes 214, 314 shown in splash plate 100, 200, the holes 214, 314 should be sufficiently small and spaced apart to avoid soil erosion and to achieve the purposes of the invention. One advantage of the holes is that they may enable metering of the water flow when the flow is moderate, rather than forcing all of the flow to run over the top of the baffle portion 208, 308. According to the soil type it may be acceptable to have even greater open area than suggested by the pictures here, to the point that the base panel 204, 304 may be screen or grid like. Furthermore, it is contemplated that the holes 214, 314 may also be located strategically within the splash plate 200, 300 to direct the water to desired flow paths.

Still other embodiments that are considered within the scope of the invention might include a splash plate 200, 300 having side upright portions 206, 306 having different shapes and sizes or a splash plate 200, 300 having no side upright portions 206, 306 at all. One embodiment would be a splash plate 200, 300 configured to interact with the end cap 100 to prevent movement within the end cap cavity. For example, the splash plate 200, 300 may include laterally extending members, such as arms or pins, configured to interact with the end cap 100. Another example would be a splash plate 200, 300 with a base panel 204, 304 sized such that a portion of the base panel 204, 304 underlies the base flange 110. The splash plate 200, 300 may also be fastened to the end cap 100 via a fastening device, such as a clip, tab, screw, pin, snap, Velcro and/or adhesive. Another embodiment may be a splash plate 200, 300 having a base panel 204, 304 and/or baffle portion 208, 308 configured to interact with the soil below/around the splash plate 200, 300, such as by protrusions that dig into the soil to prevent movement.

Another embodiment may include side upright portions 206, 306 that don't have circular cutouts 212, 312, but rather have a top portion which is square or some other shape. This would be especially appropriate for end caps 100 that only accommodate a pipe entering along the x-axis. In another embodiment, the side upright portions 206, 306 may have a width or x-axis dimension that is smaller than the x-axis dimension of the base panel 204, 304. In still another example, the side upright portions 206, 306 may comprise one or more foldable portions, such as two spaced apart segments.

In still yet another embodiment, the side upright portions 206, 306 may be configured as separate pieces as opposed to integral pieces. For instance, the side upright portions 206, 306 may be L-shaped pieces which have a base that lies in the plane of the base panel 204, 304 to which they may be mechanically associated. In still yet another embodiment, side upright portions 206, 306 may be positionably adjustable in the x-axis, y-axis and/or z-axis direction and/or sizably adjustable in the x-axis, y-axis and/or z-axis direction. In still yet another embodiment, side upright portions 206, 306 may be curved or otherwise shaped to interact with the end cap 100.

Additionally, it is contemplated that splash plate 200, 300 may be made by various methods, including injection molding. For example, in one approach splash plate 200, 300 may be made from a flat sheet (see FIG. 3 and FIG. 7) and folded to the above-described configuration(s) in the field at the point and time of installation. This provides an economical means of manufacture and shipment. One typical sheet material might be the commercial material called flutted or corrugated high density polyethylene profile board, of about 3 mm thickness and a weight of about 120 pounds per 1000 square feet; for instance, such as that made of Petrothene LR5900-00 resin and commercially available from Diversi-Plast Co., Minneapolis, Minn. Referring to FIG. 3 and FIG. 7, splash plate 200, 300 is shown in a flattened configuration, where to convert the flattened configuration of the splash plate 200, 300 into the folded shape, the flattened material may be bent along the lines labeled F1 and F2. It is contemplated that baffle portion 208, 308 and/or the side upright portions 206, 306 of splash plate 200, 300 may not be present and as such, splash plate 200, 300 may be a substantially flat plate having all or some of the features disclosed herein, such as an adjustable size. As such, these portions of the splash plate 200, 300 may be left unfolded. Alternatively, the splash plate 200, 300 may include only one foldable portion. For instance, the baffle portion 208, 308 may be fixed while the side upright portions 206, 306 may be foldable or vice versa.

Furthermore, the splash plate 200, 300 (and any portion thereof) may be adjustable in the x-axis, y-axis and/or z-axis. For example, the base panel 204, 304 may include a plurality of plates that slidably adjust in the x-axis direction to make the base panel 204, 304 longer or shorter and/or in the y-axis direction to make the base panel 204, 304 wider or thinner. Moreover the base panel 204, 304 may be adjustable in the z-axis direction via extendable legs to increase the height of the base panel 204, 304 such that base panel 204, 304 lies in a plane above the plane of the base flange 110. Also, the baffle portion 208, 308 may include a plurality of plates that slidably adjust in the y-axis direction to make the baffle portion 208, 308 wider or thinner and/or in the z-axis direction to make the baffle portion 208, 308 taller or shorter. Similarly, the side upright portions 206, 306 may include a plurality of plates that slidably adjust in the x-axis direction to make the side upright portions 206, 306 wider or thinner and/or in the z-axis direction to make the side upright portions 206, 306 taller or shorter.

It should be appreciated that end caps having other shapes than that described herein may be used with the present invention. Additionally, the present invention may be used with various types of chambers, such as those which have integrally closed ends, i.e., when the chamber has an end wall, such as that shown in U.S. Pat. No. 5,087,151 to DiTuillo. It should be further appreciated that only certain embodiments of the invention have been illustrated and that there may be other variations within the spirit and scope of the invention. For example, a splash plate 200, 300 may omit baffle portion 208, 308 and may only have side upright portions 206, 306 which lock into place so that they provide the means for resisting both lengthwise x-axis and sideways y-axis motion, when installed.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A splash plate for use with an end cap or end portion of a chamber, wherein the end cap or end portion defines an end cavity having an open end cavity bottom and includes an opening for containing a waste water pipe that introduces waste water into the end cavity, the splash plate comprising:

a base panel, wherein said base panel is configured to cover the end cavity bottom when said splash plate is associated with the chamber, such that waste water being introduced into the end cavity contacts said base panel;

a plurality of upright side portions, wherein each of said plurality of upright side portions is configured to interact with the end cap or end portion when the splash plate is associated with the chamber to inhibit longitudinal motion of the splash plate within the end cavity; and a baffle portion, wherein said baffle portion is configured to interact with the end cap or end portion when the splash plate is associated with the chamber to inhibit lateral movement of the splash plate and longitudinal movement of the baffle portion within the end cavity.

2. The splash plate of claim 1, wherein said base panel includes at least one tab portion sized and shaped to substantially fit and cover the open end cavity bottom.

3. The splash plate of claim 1, wherein said base panel includes a plurality of holes to allow water disposed on said base panel to flow into the soil disposed under said base panel.

4. The splash plate of claim 1, wherein each of said plurality of upright side portions include a semi-circular cutout portion sized to provide clearance to a waste water pipe extending into the end cavity via a side opening in the end cap or end portion.

5. The splash plate of claim 1, wherein said baffle portion includes a plurality of holes to allow water on said base panel to flow out of the end cavity and into the chamber cavity.

6. The splash plate of claim 1, wherein said baffle portion is sized to partially isolate the end cavity from the chamber cavity such that water accumulated on said base panel flows over said baffle portion and into the chamber cavity.

7. The splash plate of claim 1, further comprising an indicator portion which extends from the splash plate to be visible outside of the end cap or end portion.

8. An assembly, comprising;

an end cap or end portion of a chamber having an interior end cavity with an open end cavity bottom and a base flange; and a splash plate, wherein said splash plate comprises, a base panel disposed and configured to closely associate with said base flange to cover a substantial portion of said open end cavity bottom, such that waste water being introduced into said end cavity contacts said base panel;

a plurality of upright side portions configured to interact with said end cap or end portion to inhibit longitudinal motion of said splash plate within said end cavity; and a baffle portion configured to interact with said end cap or end portion to inhibit lateral movement of said splash plate and longitudinal movement of said baffle portion within said end cavity.

9. The assembly of claim 8, wherein said base panel includes at least one tab portion sized and shaped to substantially fit and cover said end cavity bottom.

10. The assembly of claim 8, wherein said base panel includes a plurality of holes to allow water disposed on said base panel to flow into the soil disposed under said base panel.

11. The assembly of claim 8, wherein each of said plurality of upright side portions include a semi-circular cutout portion sized to provide clearance to a waste water pipe extending into said end cavity via a side opening in said end cap or end portion.

12. The assembly of claim 8, wherein said baffle portion includes a plurality of holes to allow water on said base panel to flow out of said end cavity and into the chamber cavity.

13. The assembly of claim 8, wherein said baffle portion is sized to partially isolate said end cavity from the chamber cavity such that water accumulated on said base panel flows over said baffle portion and into the chamber cavity.

14. The splash plate of claim 8, further comprising an indicator portion which extends from the splash plate to be visible outside of the end cap or end portion.

15. A splash plate for use with an end cap or end portion of a chamber, wherein the end cap or end portion defines an end cavity having an open end cavity bottom and includes an opening for containing a waste water pipe that introduces waste water into the end cavity, the splash plate comprising:

a base panel for covering the end cavity bottom such that waste water introduced into the end cavity contacts at least a portion of said base panel;

at least one upright side portion configured to interact with said end cap or end portion to inhibit longitudinal motion of said splash plate within said end cavity;

a baffle portion configured to interact with said end cap or end portion to inhibit lateral movement of said splash plate and longitudinal movement of said baffle portion within said end cavity; and a means for positionably securing the splash plate relative to the end cap or end portion.

16. The splash plate of claim 15, wherein said base panel is configurable in size in an x-axis direction, a y-axis direction and/or a z-axis direction

17. The splash plate of claim 15, wherein said baffle portion is configurable between a horizontal configuration and a vertical configuration, wherein said baffle portion is configurable in an x-axis direction, a y-axis direction and/or a z-axis direction.

18. The splash plate of claim 17, wherein either one or both of said baffle portion and said base panel include a plurality of holes.

19. The splash plate of claim 15, wherein said at least one side upright portion configurable between a horizontal configuration and a vertical configuration, wherein said at least one side upright portion is configurable in an x-axis direction, a y-axis direction and/or a z-axis direction.

20. The splash plate of claim 15, wherein said means for positionably securing the splash plate include at least one side upright portion configured to interact with the end cap or end chamber, said baffle portion configured to interact with the end cap or end chamber and/or a base panel configured to interact with the end cap or end chamber and/or the soil within the end cap or end chamber.

* * * * *